US011280568B2

(12) United States Patent
Kung et al.

(10) Patent No.: US 11,280,568 B2
(45) Date of Patent: Mar. 22, 2022

(54) WORM-TYPE BARREL-SHROUD BULLET FEEDING STRUCTURE OF TOY GUN AND BULLET FEEDING MECHANISM THEREOF

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 16/927,720

(22) Filed: Jul. 13, 2020

(65) Prior Publication Data

US 2021/0278155 A1 Sep. 9, 2021

(30) Foreign Application Priority Data

Mar. 5, 2020 (TW) ..... 109202464

(51) Int. Cl.
*F41A 9/03* (2006.01)
*F41B 11/89* (2013.01)

(52) U.S. Cl.
CPC ..... *F41A 9/03* (2013.01); *F41B 11/89* (2013.01)

(58) Field of Classification Search
CPC ..... F41A 9/03; F41B 11/89
USPC ..... 89/33.17, 33.25; 124/41.1, 45, 48, 51.1, 124/85
See application file for complete search history.

(56) References Cited

U.S. PATENT DOCUMENTS 5,927,262 A * 7/1999 Bixler ..... A63B 69/408 124/81
6,415,781 B1 * 7/2002 Perrone ..... F41B 11/53 124/51.1
6,488,019 B2 * 12/2002 Kotsiopoulos ..... F41B 11/57 124/51.1
6,502,567 B1 * 1/2003 Christopher ..... F41B 11/53 124/51.1
6,978,776 B2 * 12/2005 Hamilton ..... F41A 9/77 124/51.1
7,441,556 B2 * 10/2008 Friesen ..... F41B 11/53 124/51.1
7,730,881 B1 * 6/2010 Pedicini ..... F04B 35/04 124/65
8,381,710 B2 * 2/2013 Nguyen ..... F41B 11/50 124/51.1
9,513,081 B2 * 12/2016 Nguyen ..... F41B 11/50
2003/0005917 A1 * 1/2003 Kim ..... A63F 9/02 124/59

(Continued)

*Primary Examiner* — John Cooper
(74) *Attorney, Agent, or Firm* — Chun-Ming Shih; HDLS IPR Services

(57) ABSTRACT

A worm-type barrel-shroud bullet feeding structure of a toy gun and a bullet feeding mechanism thereof are provided. The bullet feeding mechanism includes a bullet storing case, a bullet feeding worm and a firing assembly; wherein, a bullet storing space and a bullet feeding channel arranged at an inner side of the bullet storing case and extended along the side are disposed in the bullet storing case, and the bullet feeding channel is in communication with the bullet storing space, the bullet feeding worm is disposed in the bullet feeding channel, and the firing assembly has an active shaft utilized for driving the bullet feeding worm to rotate, thereby allowing the bullet feeding worm to drive a bullet in the bullet storing case to be displaced towards a bullet feeding direction.

15 Claims, 6 Drawing Sheets

(56) References Cited

U.S. PATENT DOCUMENTS

| | | | | |
|---|---|---|---|---|
| 2005/0274371 | A1* | 12/2005 | Lubben | F41B 11/53<br>124/51.1 |
| 2006/0157041 | A1* | 7/2006 | Friesen | F41B 11/57<br>124/51.1 |
| 2007/0012304 | A1* | 1/2007 | van Dorsser | F41B 11/57<br>124/51.1 |
| 2007/0256676 | A1* | 11/2007 | Orvis | F41B 11/57<br>124/31 |
| 2008/0236558 | A1* | 10/2008 | Bosch | F41B 11/53<br>124/48 |
| 2009/0211562 | A1* | 8/2009 | Karnis | F41B 11/50<br>124/48 |
| 2010/0095942 | A1* | 4/2010 | Kaakkola | F41B 11/57<br>124/48 |

* cited by examiner

WORM-TYPE BARREL-SHROUD BULLET FEEDING STRUCTURE OF TOY GUN AND BULLET FEEDING MECHANISM THEREOF

BACKGROUND OF THE INVENTION

Field of the Invention

The present invention relates to a toy gun, especially to a worm-type barrel-shroud bullet feeding structure of a toy gun and a bullet feeding mechanism thereof.

Description of Related Art

A conventional toy gun is mostly driven by a means of utilizing gas or electricity for achieving an effect of firing a bullet. Where, a toy gun driven by electricity is the most common product in the market.

The toy gun driven by the electricity is to utilize a motor and a gear group thereof for a purpose of driving, so that a firing assembly composed of a piston and other components can be provided with a gas pressure for firing a bullet, so as to achieve an effect of simulating a firing status of a real gun; in a process of feeding bullets, if a continuously firing function, same as the real gun, is desired to be provided to the toy gun, the bullets are required to be continuously supplied. However, in the conventional bullet feeding means, a convention magazine is filled with the bullets, then an elastic unit, for example a spring, is utilized for pushing out the bullets from the magazine, the above-mentioned bullet feeding means is unable to easily control the number of fed bullets via an electric controlling means, thus the operation is not easy to be controlled and shall be improved.

Accordingly, the applicant of the present invention has devoted himself for improving the mentioned disadvantages.

SUMMARY OF THE INVENTION

The present invention is to provide a worm-type barrel-shroud bullet feeding structure of a toy gun and a bullet feeding mechanism thereof, in which a worm is utilized for driving bullets for being displaced so as to be served as a replenishment of feeding bullets, so that the bullets can be constantly and continuously supplied, thereby providing a continuously firing function, same as a real gun, to the toy gun. Meanwhile, required components can be minimized by adopting the worm, and an advantage of maximizing an internal space can be provided.

The present invention is to provide a worm-type barrel-shroud bullet feeding structure of a toy gun and a bullet feeding mechanism thereof, in which rotation numbers of a worm can be counted by operation of a motor, thereby allowing the number of fed bullets to be more easily controlled.

Accordingly, the present invention provide a worm-type barrel-shroud bullet feeding structure of a toy gun and a bullet feeding mechanism thereof, which is disposed with respect to a gun barrel of the toy gun; the barrel-shroud bullet feeding structure includes a barrel shroud and a bullet feeding worm, the barrel shroud is formed in an elongated status and has a bullet storing slot formed through being extended along an extending direction of the gun barrel, a bullet storing space and a bullet feeding channel arranged at one side of the bullet storing slot and extended along the side of the bullet storing slot are disposed in the bullet storing slot, thereby allowing the bullet feeding worm to be disposed in the bullet feeding channel; wherein, the bullet feeding worm is able to drive a bullet stored in the bullet storing slot to be displaced along a bullet feeding direction through the bullet feeding worm being driven by the toy gun to rotate.

Accordingly, the present invention provides a worm-type bullet feeding mechanism of a toy gun, which includes a bullet storing case, a bullet feeding worm and a firing assembly; wherein, a bullet storing space and a bullet feeding channel arranged at an inner side of the bullet storing case and extended along the side are disposed in the bullet storing case, and the bullet feeding channel is in communication with the bullet storing space. The bullet feeding worm is disposed in the bullet feeding channel, and the firing assembly has an active shaft utilized for driving the bullet feeding worm to rotate, thereby allowing the bullet feeding worm to drive a bullet in the bullet storing case to be displaced towards a bullet feeding direction.

Accordingly, the present invention provides a worm-type bullet feeding structure of a toy gun, which is disposed with respect to a gun barrel of the toy gun and includes a bullet storing slot and a bullet feeding worm; the bullet storing slot is formed in an elongated status and has a bullet storing space and a bullet feeding channel arranged at one side of the bullet storing slot and extended along the side of the bullet storing slot, and the bullet feeding worm is disposed in the bullet feeding channel, wherein the toy gun is able to drive the bullet feeding worm to rotate, thereby allowing the bullet feeding worm to drive a bullet in the bullet storing slot to be displaced towards a bullet feeding direction.

DETAILED DESCRIPTION OF THE INVENTION

A preferred embodiment of the present invention will be described with reference to the drawings.

Figure 1:
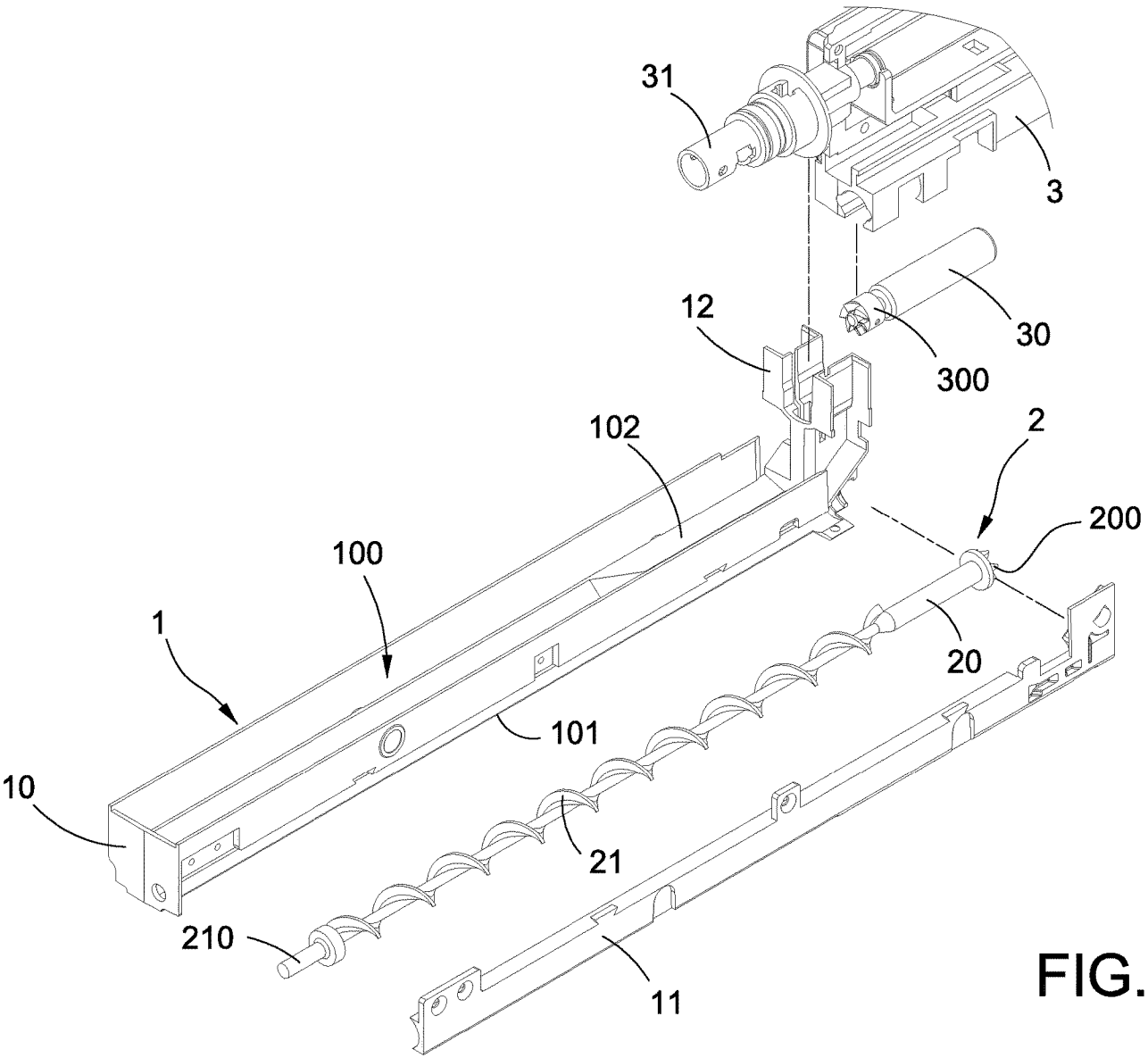
FIG. 1 is a perspective exploded view according to the present invention.
Figure 2:
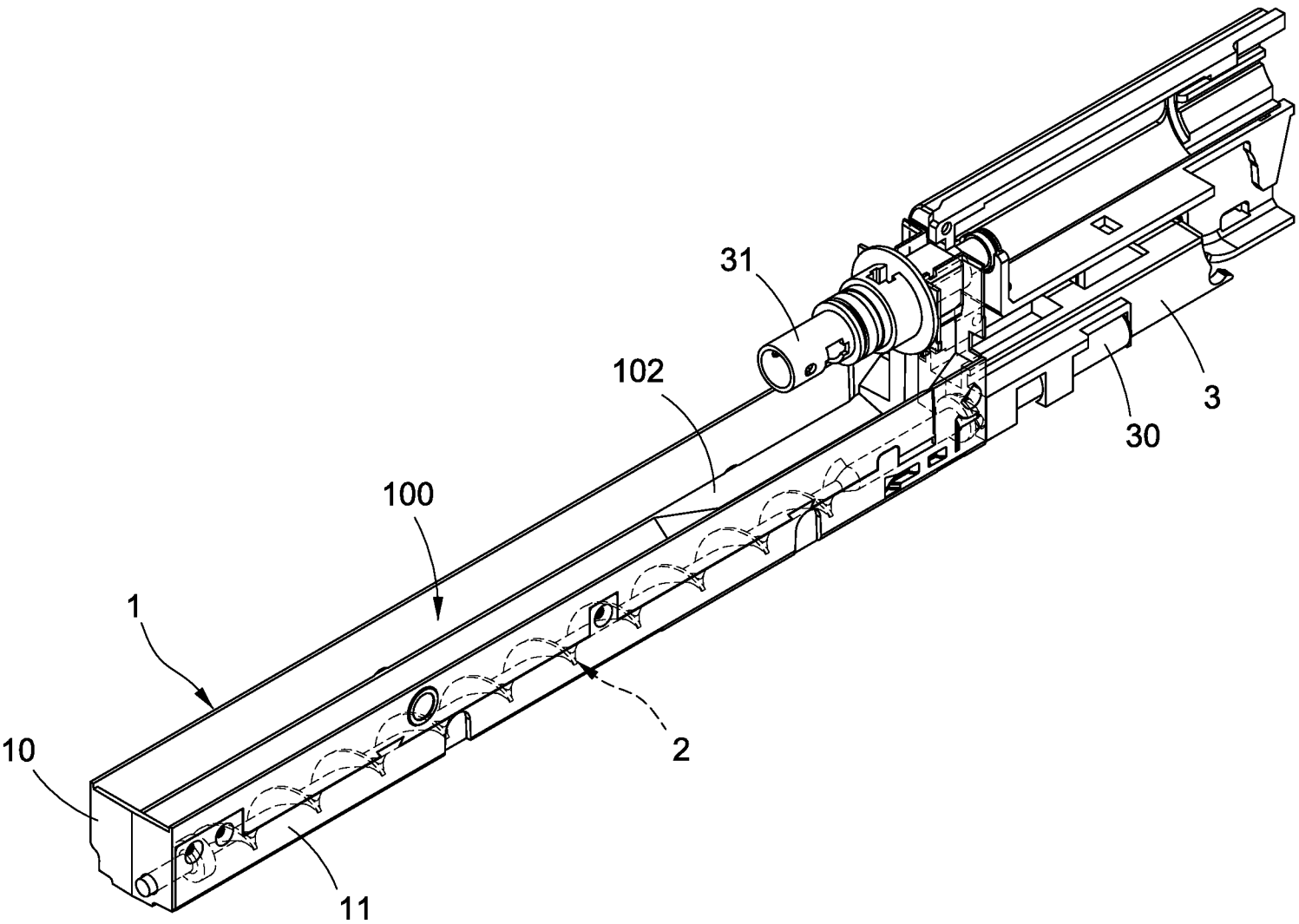
FIG. 2 is a perspective view the assembly according to the present invention.

Please refer to FIG. 1 and FIG. 2, wherein FIG. 1 is a perspective exploded view according to the present invention, and FIG. 2 is a perspective view the assembly according to the present invention. The present invention provides a worm-type barrel-shroud bullet feeding structure of a toy gun and a bullet feeding mechanism thereof, which can be disposed at a barrel-shroud location arranged at a lower portion of a gun barrel 4 of a toy gun, so as to be served as a magazine; meanwhile a principle of worm is adopted for driving bullets 40 inside the magazine for sequentially conveying the bullets 40 to a firing location, thus the toy gun is provided with a function of continuously firing. The worm-type bullet feeding mechanism includes a bullet storing case 1, a bullet feeding worm 2 and a firing assembly 3.

Figure 3:
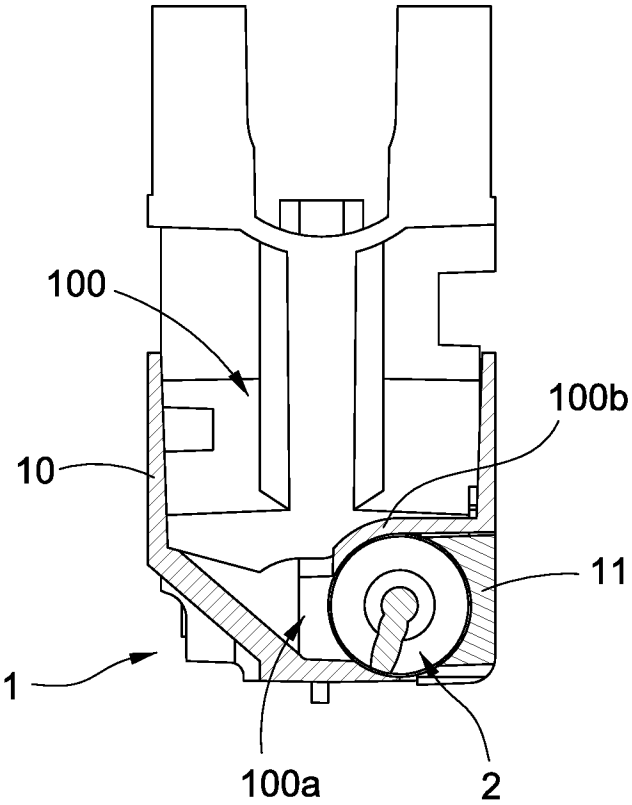
FIG. 3 is a cross sectional view showing an end surface according to the present invention.
Figure 4:
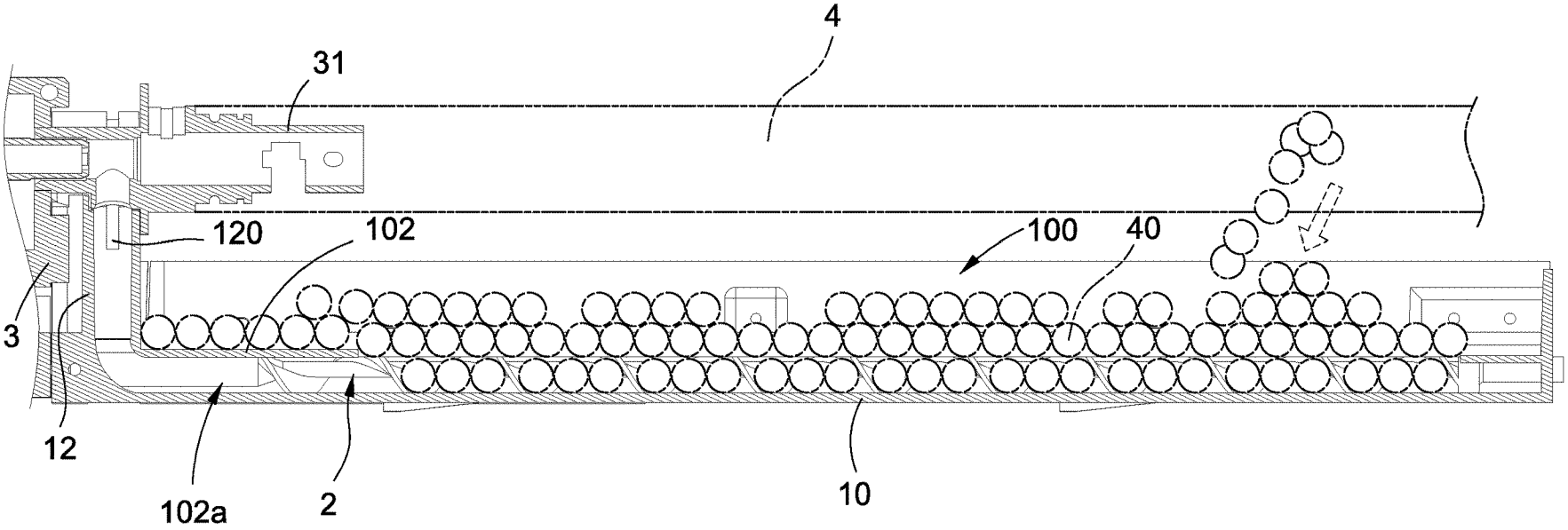
FIG. 4 is a schematic view showing the internal structure while the bullets being replenished.

The bullet storing case 1 is formed in an elongated status, and arranged at a lower portion of the gun barrel 4 of the toy gun, as shown in FIG. 4. The bullet storing case 1 can also be directly composed of a barrel-shroud of the toy gun, or an external barrel-shroud disposed at an outer side of the toy gun; substantially speaking, the above-mentioned barrel-shroud can be served as a magazine; according to one embodiment of the present invention, the bullet storing case 1 has a bullet storing slot 10 along an extending direction of the gun barrel 4. The bullet storing slot 10 has a bullet storing space 100 having an upwardly-facing opening, and a bullet feeding channel 101 disposed at one inner side of the bullet storing slot 10 and extended along the side of the bullet storing slot 10, and the bullet feeding channel 101 allows the bullet feeding worm 2 to be disposed in the bullet feeding channel 101 along an extending direction of the bullet feeding worm 2. Please refer to FIG. 3. The bullet feeding channel 101 is in communication with the bullet storing space 100, a notch 100*a* allowing the bullet 40 to pass is formed between the bullet feeding channel 101 and the bullet storing space 100, and a block part 100*b* is formed in the bullet feeding slot 10 and arranged above the bullet feeding channel 101, so that the bullet feeding channel 101 is formed through the block part 100*b* being arranged at an inner side of the bullet feeding slot 101, and the bullet feeding worm 2 can be easily disposed therein.

Based on what has been mentioned above, the bullet feeding worm 2 has a linkage end 20, and a worm end 21 axially extended from the linkage end 20, and a distal location of the worm end 21 has a pivotal shaft 210, so that after the bullet feeding worm 2 is axially disposed inside the bullet feeding channel 101, the bullet feeding worm 2 is able to pivoted to the bullet storing slot 10 via the pivotal shaft 210, thereby enabling the bullet feeding worm 2 to be driven to rotate through a power source (not shown in figures), or a stepping motor can be utilized for counting rotation numbers of the bullet feeding worm 2 for achieving an object of precisely controlling the number of fed bullets; accordingly, the worm-type barrel-shroud bullet feeding structure of the present invention is provided; the above-mentioned power source can be a driving component, for example a motor, of the toy gun. Moreover, for enabling the bullet feeding worm 2 to be easily assembled, according to one embodiment of the present invention, the bullet feeding channel 101 is formed through being concavely formed at one side of the bullet storing slot 10, and an assembling cover 11 is provided at an outer side of the bullet storing slot 10 for covering the bullet feeding channel 101, thereby preventing the bullet feeding worm 2 to be exposed.

The firing assembly 3 is a main component of the toy gun for a purpose of firing, and may be composed of a power source, for example a motor, a trigger and others; after the above-mentioned power source is utilized for driving some components, for example a gear group (not shown in figures), the bullet 40 can be fired after pulling the trigger. The firing assembly 3 is mainly consisted of an active shaft 30 driven by the power source so as to drive the bullet feeding worm 2 to rotate, and a bullet firing barrel 31 allowing the bullet 40 to enter the gun barrel 4 while the bullet 40 being fired, so that when the trigger is pulled, the firing assembly 3 enables the loaded bullet 40 to be fired through the bullet firing barrel 31, and links the active shaft 30 to drive the bullet feeding worm 2 to rotate, thus the bullets 40 stored in the bullet storing case 1 can be sequentially fed for a next firing operation.

Please refer to FIG. 4. The bullet storing case 1 is able to be externally replenished with the bullets 40 through a various means, for example the bullet storing case 1 is detached from the toy gun then the bullets 40 are filled from a top end of the bullet storing slot 10 so as to be stored in the bullet storing space 100, or a bullet replenishing hole can be additionally provided for allowing the bullets 40 in a bullet bottle (not shown in figures) to be filled in the bullet storing space 100; accordingly, any means can be adopted as long as the bullets 40 can be filled and stored in the bullet storing space 100. The bullet 40 stored in the bullet storing space 100 is able to pass the notch 100*a*, having a dimension just allowing the bullet 40 to pass, for entering the bullet feeding channel 101, so that the bullet 40 can be driven by the worm end 21 of the bullet feeding worm 2 for being displaced towards a bullet feeding direction. What shall be addressed is that: the worm end 21 can be formed in a spiral status in the clockwise or the counterclockwise direction, and the bullet feeding direction is determined with respect to the bullet feeding worm 2 being normally or reversely rotated. According to one embodiment of the present invention, the bullet storing case 1 has a bullet guiding part 12 located in the bullet storing space 100 and arranged close to the linkage end 20 of the bullet feeding worm 2, a guiding hole 120 engaged between the bullet feeding channel 101 and the firing assembly 3 is formed in the bullet guiding part 12, so that the bullet 40 driven by the bullet feeding worm 2 is able to pass the guiding hole 120 and conveyed to the firing assembly 3 for being in a ready-to-fire status. Moreover, a shielding part 102 is disposed between the bullet guiding part 12 and the bullet storing slot 10 and used for shielding on a top end of the bullet feeding channel 101, a width of the shielding part 102 is gradually reduced for enabling the bullets 40 to be collected so as to enter the bullet feeding channel 101, and a bullet feeding hole 102*a* communicated with the bullet feeding channel 101 is formed. The bullet feeding hole 102*a* is in communication with the guiding hole 120, thus the bullets 40 stored in the bullet storing space 100 can be more easily collected for entering the bullet feeding hole 102*a*, then the bullet 40 is conveyed to the firing assembly 3 through the guiding hole 120 for being in the ready-to-fire status.

Figure 5:
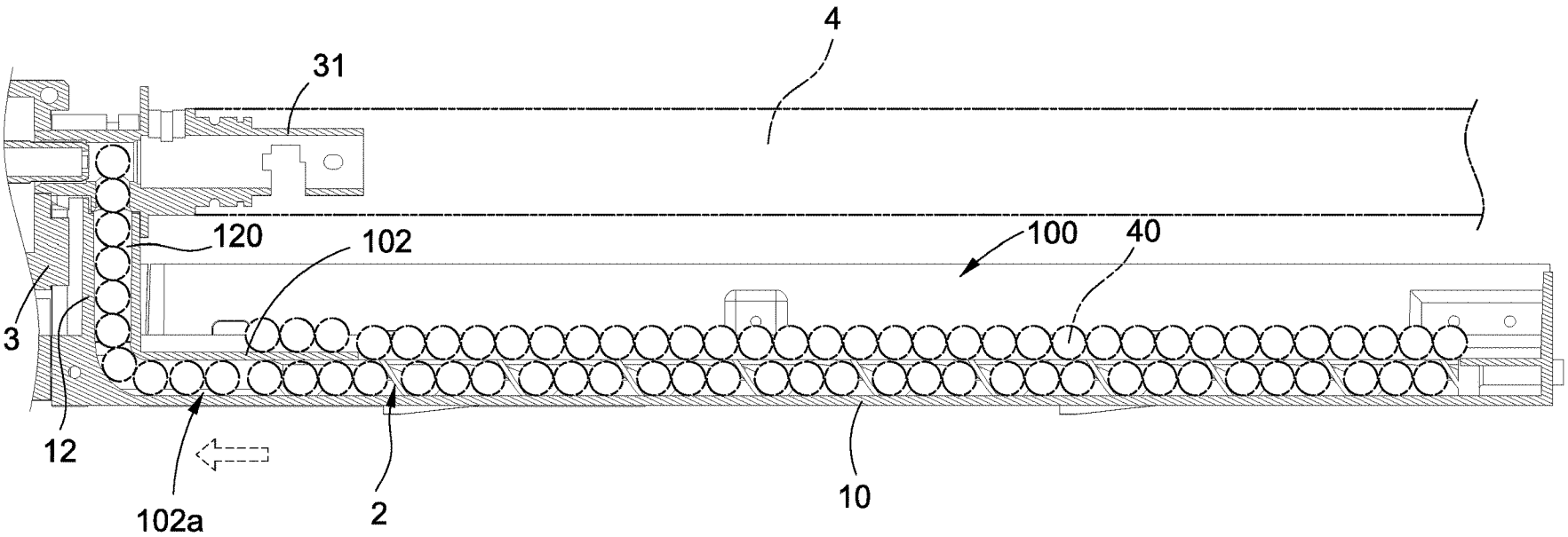
FIG. 5 is a schematic view showing the internal structure while the bullets being fed.

Please refer to FIG. 5. After the firing assembly 3 is driven by the power source, the bullet 40 is able to pass the bullet firing barrel 3 and fired from the gun barrel 4 through pulling the trigger; meanwhile the active shaft 30 is driven to continuously link the bullet feeding worm 2 to rotate for enabling the bullets 40 in the bullet storing space 100 to continuously pass the bullet feeding hole 102*a* and the guiding hole 120 for being conveyed to the firing assembly 3 for being fired in the next time or a continuously firing function can be provided.

Figure 6:
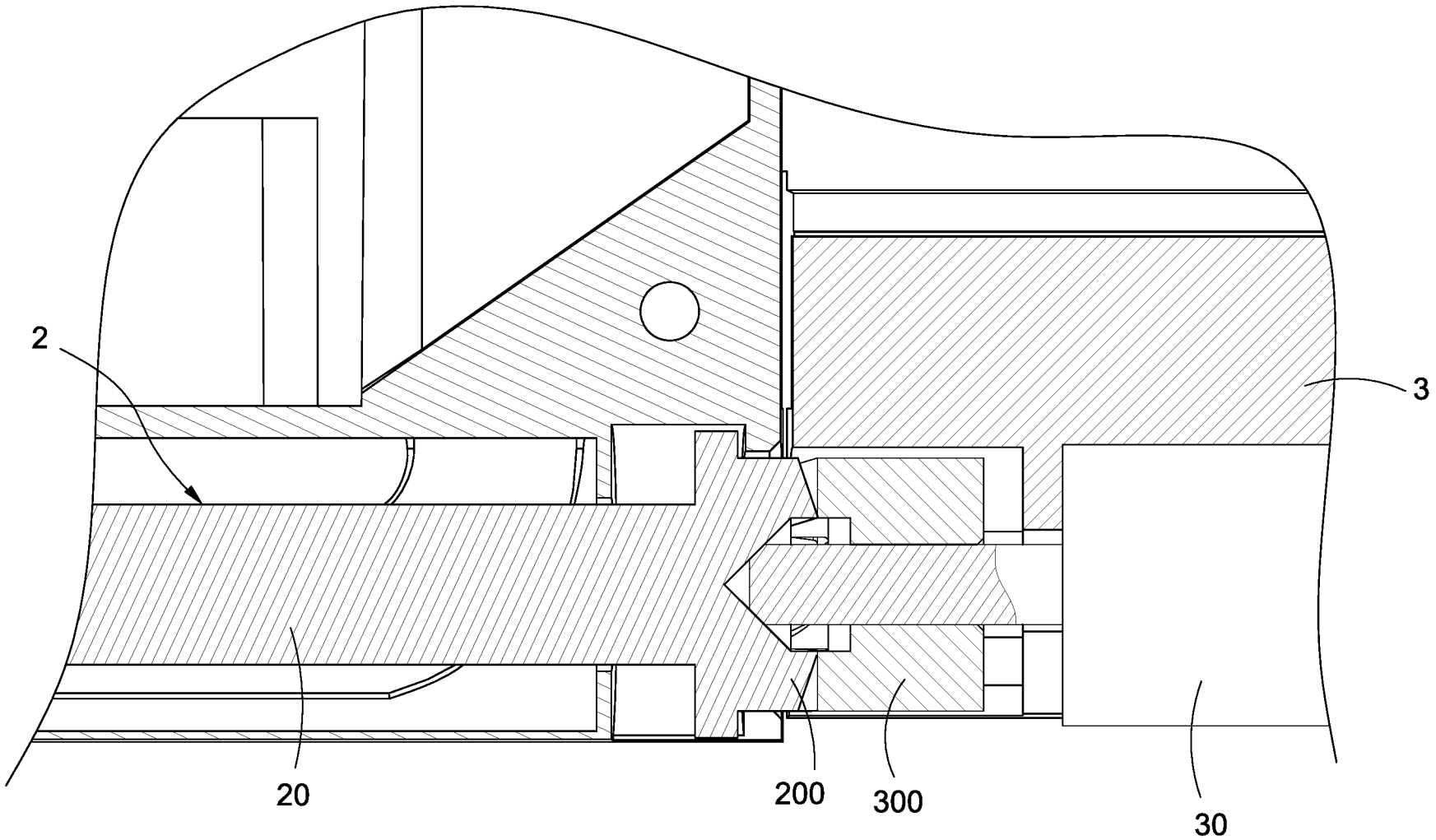
FIG. 6 is a partially enlarged view showing the active shaft and the linkage end according to the present invention.

Please refer to FIG. 6. For allowing the active shaft 30 of the firing assembly 3 to be connected to the bullet feeding worm 2 for a purpose of transmission, a first combination part 200 is disposed on the linkage end 20 of the bullet feeding worm 2, and a matched second combination part 300 is disposed on the active shaft 30. The first combination part 200 and the second combination part 300 can be bevel gears capable of being mutually engaged, so that when each component of the toy gun is assembled, an objective of establishing transmission can be achieved through the first combination part 200 being mutually engaged with the second combination part 300, and operations of disassembling or repairing the toy gun or replacing components can be facilitated.

Accordingly, with the above-mentioned structure and assembly, the worm-type barrel-shroud bullet feeding structure of the toy gun and the bullet feeding mechanism thereof are provided by the present invention.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A worm barrel-shroud bullet feeding structure of a toy gun, disposed on one side of a gun barrel of the toy gun, and including:

a barrel shroud, formed in an elongated status and having a bullet storing slot extended along an extending direction of the gun barrel, the bullet storing slot comprising a bullet storing space and a bullet feeding channel, the bullet feeding channel arranged in one side of the bullet storing slot and extended along the side of the bullet storing slot; and a bullet feeding worm, disposed in the bullet feeding channel;

wherein, the bullet feeding worm is being rotated to drive a bullet stored in the bullet storing slot to move along a bullet feeding direction, wherein the bullet storing slot further comprises a bullet guiding part located in the bullet storing space, the bullet guiding part comprises a guiding hole disposed on one end thereof away from the bullet feeding worm, and an axial line of the bullet guiding part passes through a center of the guiding hole.

2. The worm barrel-shroud bullet feeding structure of the toy gun according to claim 1, wherein a notch just allowing the bullet to pass is formed between the bullet feeding channel and the bullet storing space.

3. The worm barrel-shroud bullet feeding structure of the toy gun according to claim 1, wherein a block part is formed in the bullet storing slot and arranged above the bullet feeding channel, so that the bullet feeding channel is formed through the block part being arranged at an inner side of the bullet storing slot.

4. The worm barrel-shroud bullet feeding structure of the toy gun according to claim 1, wherein the bullet feeding channel is formed through being concavely formed at one side of the bullet storing slot.

5. The worm barrel-shroud bullet feeding structure of the toy gun according to claim 4, wherein an assembling cover is provided at an outer side of the bullet storing slot for covering the bullet feeding channel.

6. The worm barrel-shroud bullet feeding structure of the toy gun according to claim 1, wherein the bullet feeding worm has a linkage end, and a worm end axially extended from the linkage end, and a distal location of the worm end has a pivotal shaft, and the pivotal shaft is disposed in the bullet storing slot.

7. The worm barrel-shroud bullet feeding structure of the toy gun according to claim 1, wherein a shielding part is disposed between the bullet guiding part and the bullet storing slot and used for shielding on a top end of the bullet feeding channel, a bullet feeding hole communicated with the bullet feeding channel is provided, and the bullet feeding hole is in communication with the guiding hole.

8. A worm bullet feeding mechanism of a toy gun, including:

a bullet storing case, having a bullet storing space and a bullet feeding channel arranged in and extended along side of the bullet storing case, wherein the bullet feeding channel is in communication with the bullet storing space;

a bullet feeding worm, disposed in the bullet feeding channel, and a firing assembly, having an active shaft configured to drive the bullet feeding worm to rotate to drive a bullet in the bullet storing case to move toward a bullet feeding direction, wherein the bullet storing case further comprises a bullet guiding part located in the bullet storing space, the bullet guiding part comprises a guiding hole disposed on one end thereof away from the bullet feeding worm, and an axial line of the bullet guiding part passes through a center of the guiding hole.

9. The worm bullet feeding mechanism of the toy gun according to claim 8, wherein a notch just allowing the bullet to pass is formed between the bullet feeding channel and the bullet storing space.

10. The worm bullet feeding mechanism of the toy gun according to claim 8, wherein a block part is formed in the bullet storing case and arranged above the bullet feeding channel, so that the bullet feeding channel is formed through the block part being arranged at an inner side of the bullet storing case.

11. The worm bullet feeding mechanism of the toy gun according to claim 8, wherein the bullet feeding channel is formed through being concavely formed at one side of the bullet storing case.

12. The worm bullet feeding mechanism of the toy gun according to claim 11, wherein an assembling cover is provided at an outer side of the bullet storing case for covering the bullet feeding channel.

13. The worm bullet feeding mechanism of the toy gun according to claim 8, wherein the bullet feeding worm has a linkage end, and a worm end axially extended from the linkage end, and a distal location of the worm end has a pivotal shaft, and the pivotal shaft is disposed in the bullet storing case.

14. The worm bullet feeding mechanism of the toy gun according to claim 8, wherein a shielding part is disposed between the bullet guiding part and the bullet storing case and used for shielding on a top end of the bullet feeding channel, a bullet feeding hole communicated with the bullet feeding channel is provided, and the bullet feeding hole is in communication with the guiding hole.

15. A worm bullet feeding structure of a toy gun, disposed on one side of a gun barrel of the toy gun, and including:

a bullet storing slot, formed in an elongated status, and having a bullet storing space and a bullet feeding channel arranged in one side of the bullet storing slot and extended along the side of the bullet storing slot; and a bullet feeding worm, disposed in the bullet feeding channel;

wherein the toy gun drives the bullet feeding worm to rotate to drive a bullet in the bullet storing slot to move toward a bullet feeding direction, wherein the bullet storing slot further comprises a bullet guiding part located in the bullet storing space, the bullet guiding part comprises a guiding hole disposed on one end thereof away from the bullet feeding worm, and an axial line of the bullet guiding part passes through a center of the guiding hole.

* * * * *